US007789151B2

(12) United States Patent
Langeslag

(10) Patent No.: US 7,789,151 B2
(45) Date of Patent: Sep. 7, 2010

(54) PLUG PROTECTION SYSTEM AND METHOD

(75) Inventor: René Langeslag, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/141,224

(22) Filed: Jun. 18, 2008

(65) Prior Publication Data

US 2009/0283270 A1 Nov. 19, 2009

Related U.S. Application Data

(60) Provisional application No. 61/052,919, filed on May 13, 2008.

(51) Int. Cl.
*E21B 43/10* (2006.01)

(52) U.S. Cl. ..... 166/296; 166/229; 166/205

(58) Field of Classification Search ..... 166/276, 166/285, 296, 242.1, 229, 205, 376
See application file for complete search history.

(56) References Cited

U.S. PATENT DOCUMENTS

| | | | | |
|---|---|---|---|---|
| 1,362,552 | A | 12/1920 | Alexander et al. | |
| 1,649,524 | A | 11/1927 | Hammond | |
| 1,915,867 | A | 6/1933 | Penick | |
| 1,984,741 | A | 12/1934 | Harrington | |
| 2,089,477 | A | 8/1937 | Halbert | |
| 2,119,563 | A | 6/1938 | Wells | |
| 2,214,064 | A | 9/1940 | Niles | |
| 2,257,523 | A | 9/1941 | Combs | |
| 2,391,609 | A * | 12/1945 | Wright | 166/228 |
| 2,412,841 | A | 12/1946 | Spangler | |
| 2,762,437 | A | 9/1956 | Egan et al. | |
| 2,810,352 | A | 10/1957 | Tumlison | |
| 2,814,947 | A | 12/1957 | Stegemeier et al. | |
| 2,942,668 | A | 6/1960 | Maly et al. | |
| 2,945,541 | A | 7/1960 | Maly et al. | |
| 3,103,789 | A | 9/1963 | McDuff | |
| 3,273,641 | A * | 9/1966 | Bourne | 166/276 |
| 3,302,408 | A | 2/1967 | Schmid | |
| 3,322,199 | A * | 5/1967 | Van Note, Jr. | 166/205 |
| 3,326,291 | A * | 6/1967 | Zandmer | 166/100 |
| 3,385,367 | A | 5/1968 | Kollsman | |

(Continued)

FOREIGN PATENT DOCUMENTS

| | | |
|---|---|---|
| CN | 1385594 | 12/2002 |

(Continued)

OTHER PUBLICATIONS

Restarick, Henry. "Horizontal Completion Options in Reservoirs with Sand Problems," Society of Petroleum Engineers: SPE 29831. Mar. 11-14, 1995. 16 pages.

(Continued)

*Primary Examiner*—Daniel P Stephenson
(74) *Attorney, Agent, or Firm*—Cantor Colburn LLP

(57) ABSTRACT

Disclosed herein is a downhole plug protection system. The system includes, a tubular having perforations in a perforated portion, a screen in fluidic communication with the tubular, and a ring in sealable communication with the tubular and attached to the screen the ring having an extended portion positioned radially outwardly of the perforated portion.

13 Claims, 3 Drawing Sheets

U.S. PATENT DOCUMENTS 3,386,508 A 6/1968 Bielstein et al.
3,419,089 A 12/1968 Venghiattis
3,451,477 A 6/1969 Kelley
RE27,252 E 12/1971 Sklar et al.
3,675,714 A 7/1972 Thompson
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
4,173,255 A 11/1979 Kramer
4,180,132 A 12/1979 Young
4,186,100 A 1/1980 Mott
4,250,907 A 2/1981 Struckman et al.
4,257,650 A 3/1981 Allen
4,265,485 A 5/1981 Boxerman et al.
4,287,952 A 9/1981 Erbstoesser
4,390,067 A 6/1983 Willman
4,415,205 A 11/1983 Rehm et al.
4,434,849 A 3/1984 Allen
4,463,988 A 8/1984 Bouck et al.
4,491,186 A 1/1985 Alder
4,497,714 A 2/1985 Harris
4,552,218 A 11/1985 Ross et al.
4,572,295 A 2/1986 Walley
4,614,303 A 9/1986 Moseley, Jr. et al.
4,649,996 A 3/1987 Kojicic et al.
4,821,800 A 4/1989 Scott et al.
4,856,590 A 8/1989 Caillier
4,917,183 A 4/1990 Gaidry et al.
4,974,674 A 12/1990 Wells
4,998,585 A 3/1991 Newcomer et al.
5,004,049 A 4/1991 Arterbury
5,156,811 A 10/1992 White
5,217,076 A 6/1993 Masek
5,333,684 A 8/1994 Walter et al.
5,337,821 A 8/1994 Peterson
5,339,895 A 8/1994 Arterbury et al.
5,339,897 A 8/1994 Leaute
5,355,956 A * 10/1994 Restarick ..... 166/296
5,377,750 A 1/1995 Arterbury et al.
5,381,864 A 1/1995 Nguyen et al.
5,384,046 A 1/1995 Lotter et al.
5,431,346 A 7/1995 Sinaisky
5,435,393 A 7/1995 Brekke et al.
5,435,395 A 7/1995 Connell
5,439,966 A 8/1995 Graham et al.
5,511,616 A 4/1996 Bert
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols et al.
5,829,520 A 11/1998 Johnson
5,831,156 A 11/1998 Mullins
5,839,508 A 11/1998 Tubel et al.
5,873,410 A 2/1999 Iato et al.
5,881,809 A 3/1999 Gillespie et al.
5,982,801 A 11/1999 Deak
6,044,869 A 4/2000 Koob
6,068,015 A 5/2000 Pringle
6,112,815 A 9/2000 Bøe et al.
6,112,817 A 9/2000 Voll et al.
6,228,812 B1 5/2001 Dawson et al.
6,253,847 B1 7/2001 Stephenson
6,253,861 B1 7/2001 Carmichael et al.
6,273,194 B1 8/2001 Hiron et al.
6,305,470 B1 10/2001 Woie
6,325,152 B1 12/2001 Kelley et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnarson et al.
6,530,431 B1 3/2003 Castano-Mears et al.
6,561,732 B1 5/2003 Bloomfield et al.
6,581,681 B1 6/2003 Zimmerman et al.
6,622,794 B2 9/2003 Zisk, Jr.
6,632,527 B1 10/2003 McDaniel et al.
6,635,732 B2 10/2003 Mentak
6,667,029 B2 12/2003 Zhong et al.
6,679,324 B2 1/2004 Den Boer et al.
6,692,766 B1 2/2004 Rubinstein et al.
6,699,503 B1 3/2004 Sako et al.
6,699,611 B2 3/2004 Kim et al.
6,722,437 B2 4/2004 Vercaemer et al.
6,786,285 B2 9/2004 Johnson et al.
6,817,416 B2 11/2004 Wilson et al.
6,830,104 B2 12/2004 Nguyen et al.
6,831,044 B2 12/2004 Constien
6,840,321 B2 1/2005 Restarick et al.
6,863,126 B2 3/2005 McGlothen et al.
6,896,049 B2 5/2005 Moyes
6,938,698 B2 9/2005 Coronado
6,951,252 B2 10/2005 Restarick et al.
6,976,542 B2 12/2005 Henriksen et al.
7,032,675 B2 4/2006 Steele et al.
7,084,094 B2 8/2006 Gunn et al.
7,159,656 B2 1/2007 Eoff et al.
7,185,706 B2 3/2007 Freyer
7,258,166 B2 8/2007 Russell
7,290,610 B2 11/2007 Corbett et al.
7,318,472 B2 1/2008 Smith
7,322,412 B2 1/2008 Badalamenti et al.
7,325,616 B2 2/2008 Lopez de Cardenas et al.
7,360,593 B2 4/2008 Constien
7,395,858 B2 7/2008 Barbosa et al.
7,409,999 B2 8/2008 Henriksen et al.
7,413,022 B2 8/2008 Broome et al.
7,451,814 B2 11/2008 Graham et al.
7,469,743 B2 * 12/2008 Richards ..... 166/242.1
7,621,326 B2 11/2009 Crichlow
7,644,854 B1 1/2010 Holmes et al.
2002/0125009 A1 9/2002 Wetzel et al.
2003/0221834 A1 12/2003 Hess et al.
2004/0052689 A1 3/2004 Yao
2004/0060705 A1 4/2004 Kelley
2004/0144544 A1 7/2004 Freyer
2004/0159447 A1 8/2004 Bissonnette et al.
2004/0194971 A1 10/2004 Thomson
2005/0016732 A1 1/2005 Brannon et al.
2005/0086807 A1 4/2005 Richard et al.
2005/0126776 A1 * 6/2005 Russell ..... 166/229
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0048936 A1 3/2006 Fripp et al.
2006/0048942 A1 3/2006 Moen et al.
2006/0076150 A1 4/2006 Coronado et al.
2006/0086498 A1 4/2006 Wetzel et al.
2006/0108114 A1 5/2006 Johnson
2006/0118296 A1 * 6/2006 Dybevik et al. ..... 166/242.1
2006/0124360 A1 6/2006 Lee et al.
2006/0157242 A1 7/2006 Graham et al.
2006/0175065 A1 8/2006 Ross
2006/0185849 A1 8/2006 Edwards et al.
2006/0250274 A1 11/2006 Mombourquette et al.
2006/0272814 A1 12/2006 Broome et al.
2007/0039741 A1 * 2/2007 Hailey ..... 166/376

| | | | | |
|---|---|---|---|---|
| 2007/0044962 | A1 | 3/2007 | Tibbles | |
| 2007/0131434 | A1 | 6/2007 | MacDougall et al. | |
| 2007/0181299 | A1 | 8/2007 | Chung et al. | |
| 2007/0246210 | A1 | 10/2007 | Richards | |
| 2007/0246225 | A1 | 10/2007 | Hailey, Jr. et al. | |
| 2008/0035350 | A1 | 2/2008 | Henriksen et al. | |
| 2008/0053662 | A1 | 3/2008 | Williamson et al. | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0169099 | A1* | 7/2008 | Pensgaard | 166/285 |
| 2008/0236839 | A1 | 10/2008 | Oddie | |
| 2008/0236843 | A1 | 10/2008 | Scott et al. | |
| 2008/0283238 | A1 | 11/2008 | Richards et al. | |
| 2009/0057014 | A1 | 3/2009 | Richard et al. | |
| 2009/0194282 | A1 | 8/2009 | Beer et al. | |
| 2009/0301704 | A1 | 12/2009 | Dillett et al. | |

FOREIGN PATENT DOCUMENTS

| | | |
|---|---|---|
| GB | 1492345 | 6/1976 |
| GB | 2341405 | 3/2000 |
| JP | 59089383 | 5/1984 |
| SU | 1335677 | 8/1985 |
| WO | 9403743 | 2/1994 |
| WO | 0079097 | 12/2000 |
| WO | 0165063 | 9/2001 |
| WO | 0177485 | 10/2001 |
| WO | 02075110 | 9/2002 |
| WO | 2004018833 A1 | 3/2004 |
| WO | 2006015277 | 2/2006 |

OTHER PUBLICATIONS

Hackworth, et al. "Development and First Application of Bistable Expandable Sand Screen," Society of Petroleum Engineers: SPE 84265. Oct. 5-8, 2003. 14 pages.

Gaudette, et al. "Permeable Medium Flow Control Devices for Use in Hydrocarbon Production." U.S. Appl. No. 11/875,584, filed Oct. 19, 2007. Specification having 16 pages, Figures having 5 sheets.

Richard, et al. "Multi-position Valves for Fracturing and Sand Control and Associated Completion Methods." U.S. Appl. No. 11/949,403, filed Dec. 3, 2007. Specification having 13 pages, Figures having 11 sheets.

"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.

"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 59558.

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.

E.L. Joly, et al. New Production Logging Technique for Horizontal Wells. SPE 14463 1988.

Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.

Mathis, Stephen P. "Sand Management: A Review of Approaches and Conerns," SPE 82240, The Hague, The Netherlands, May 13-14, 2003. 7 pages.

Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29, Houston, Texas, 2004, Society of Patent Engineers.

Pardo, et al. "Completion, Techniques Used in Horizontal Wells Drilled in Shallow Gas Sands in the Gulf of Mexio". SPE 24842. Oct. 4-7, 1992.

R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.

Tanaka, T., Ricka, J., (1984) Swelling of Ionic gels: Quantitative performance of the Donnan Thory, Macromolecules, 17, 2916-2921.

Tanaka, T., Nishio, I., Sun, S.T., Uena-Nisho, S. (1982) Collapse of gels in an electric field, Science, 218-467-469.

International Search Report and Written Opinion, Mailed Feb. 2, 2010, International Appln. No. PCT/US2009/049661, Written Opinion 7 Pages, International Search Report 3 Pages.

* cited by examiner

PLUG PROTECTION SYSTEM AND METHOD

CROSS REFERENCE TO RELATED APPLICATION

This application claims priority to U.S. Provisional Application No. 61/052,919, filed on May 13, 2008, the entire contents of which are incorporated herein by reference.

BACKGROUND OF THE INVENTION

It is common to plug fluidic openings, such as, screens, perforations and flow ports, for example, formed in tubular walls of drillstring members while the tool is being run downhole. Plugging of such flow ports prevents borehole fluids from infiltrating the drillstring during the running process, thereby reducing the weight of the drillstring through the buoyancy forces generated by wellbore fluid upon the drillstring. Further, lower density fluids can be contained within the string to adjust buoyancy. These buoyancy forces can be particularly helpful when running a tool into a highly deviated or horizontal wellbore in reducing frictional forces between the tool and the wellbore by floating the tool into position.

However, scraping of the drillstring along at least some of the walls of a wellbore during running is unavoidable. Such scraping abrades materials used to plug flow openings often weakening such plugging to the point of failure, thereby allowing fluid to fill the drillstring, negating the buoyancy effect and benefits resulting therefrom. Consequently, systems and methods assisting the reliable running of tools would be well received in the art.

BRIEF DESCRIPTION OF THE INVENTION

Disclosed herein is a downhole plug protection system. The system includes, a tubular having perforations in a perforated portion, a screen in fluidic communication with the tubular, and a ring in sealable communication with the tubular and attached to the screen the ring having an extended portion positioned radially outwardly of the perforated portion.

Further disclosed herein is a method of protecting a plugged perforated tubular while running downhole. The method includes, perforating a portion of a tubular, sealedly attaching a ring to a non-perforated portion of the tubular, perimetrically surrounding a perforated portion with a longitudinally extended portion of the ring, plugging the perforations, and running the plugged perforated tubular downhole.

Further disclosed herein is a method of making a protected and plugged perforated tubular. The method includes, perforating a portion of a tubular, sealedly attaching a ring to a non-perforated portion of the tubular, perimetrically surrounding a perforated portion with a longitudinally extended portion of the ring, and plugging the perforations.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
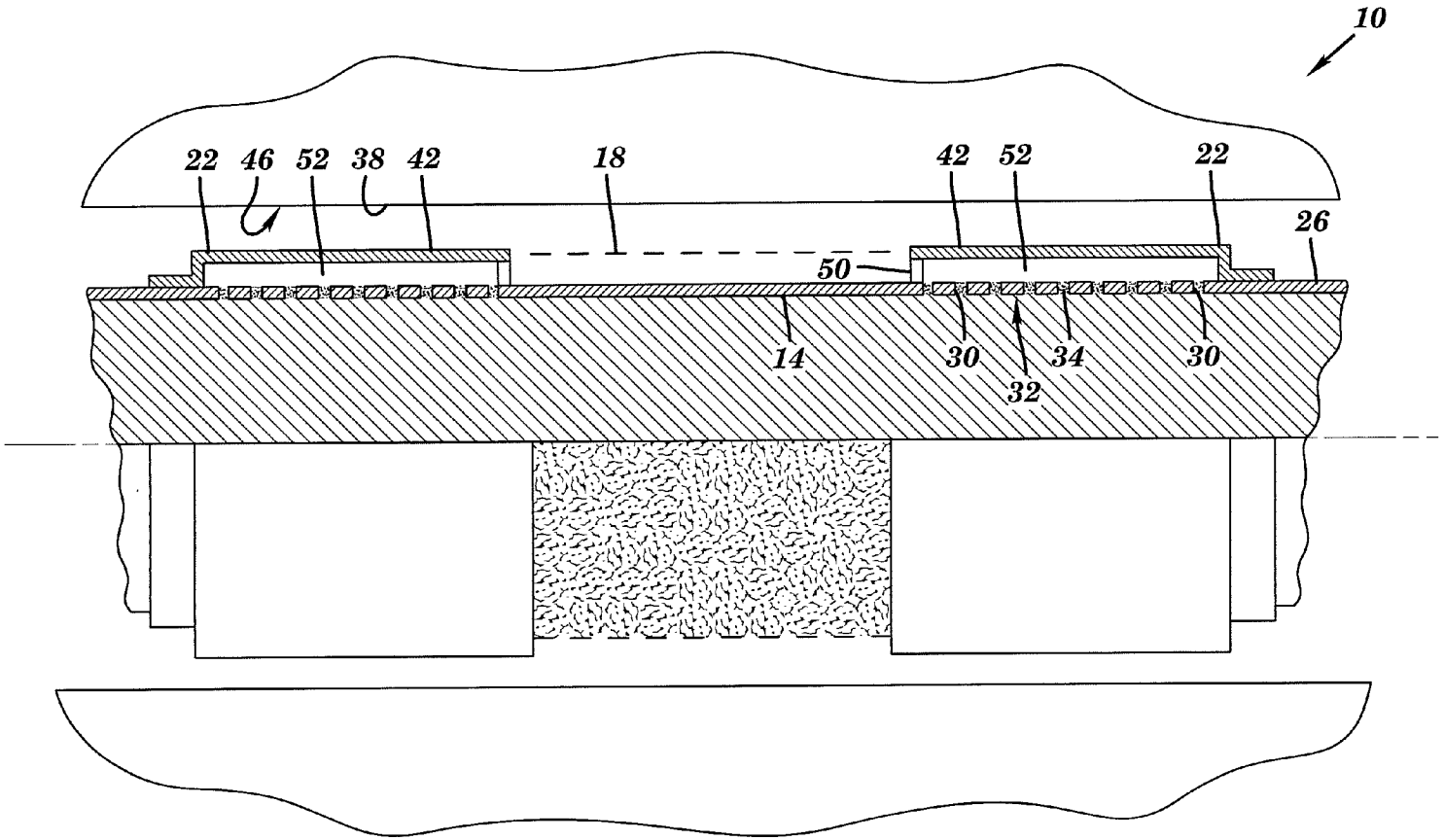
FIG. 1 depicts a partial cross sectional view of a plug protection system disclosed herein illustrated in a plugged condition.

Referring to FIG. 1, an embodiment of a plug protection system 10 disclosed herein is illustrated. The plug protection system 10 includes, a perforated tubular member 14, shown herein as a perforated base pipe, and a screen 18, sealedly attached to the perforated tubular member 14, by end rings 22 on opposing longitudinal ends of the screen 18. The perforated tubular member 14, in this embodiment, has a wall 26 with a plurality of ports 30 extending therethrough in two perforated portions 32. The ports 30 are openings through which fluid, such as wellbore fluid, is flowable when the ports 30 are not plugged. The ports 30 may be any of a variety of shapes, such as, round, oval, or rectangular (to form slots), for example. The ports 30 are sized to be fluidically pluggable by any of a variety of downhole degradable materials 34, such as paraffin, and/or polymers, for example, that are used for such purposes. The degradability of the materials 34 allows the ports 30 to be opened sometime after being positioned at a desired location within a wellbore 38. The degradable materials 34 may be degradable in response to exposure to elevated temperatures, for example, that permit a well operator to open the ports 30, when desired, by pumping steam (or other heat source in the case of a heat degradable material) downhole to heat the perforated tubular member 14 and the degradable material 34. Alternate degradable materials 34 include materials that degrade when exposed to acid or other chemical compositions. Acid, for example, can be pumped downhole to expose the materials 34 thereto when opening of the ports 30 is desirable.

Longitudinal extensions 42 of the end rings 22 extend perimetrically to surround the perforated portions 32 of the perforated tubular member 14. As such, the longitudinal extensions 42 protect the perforated portions 32 from direct contact with walls 46 of the wellbore 38. By preventing abrasion of the degradable material 34 against the walls 46, seal integrity of the degradable material 34 in the ports 30 can be maintained.

A length of the longitudinal extensions 42 can be designed to match a length of the perforated portions 32, so that none of the ports 30 are exposed to direct abrasive contact with the walls 46. Discontinuous non-sealing standoffs 50 can be positioned between the longitudinal extensions 42 and the perforated tubular member 14 to provide structural support and centering of the longitudinal extensions 42 relative to the perforated tubular member 14.

Additionally, an annular space 52 defined by the longitudinal extensions 42 and the perforated portions 32 could also be plugged with plugging material 34 to increase pressure differentials required to extrude the plugging material 34. Having this additional volume of plugging material 34 could also increase a time exposed to elevated temperatures or acid before the plugging material 34 sufficiently degrades to be forced through the ports 30.

Figure 2:
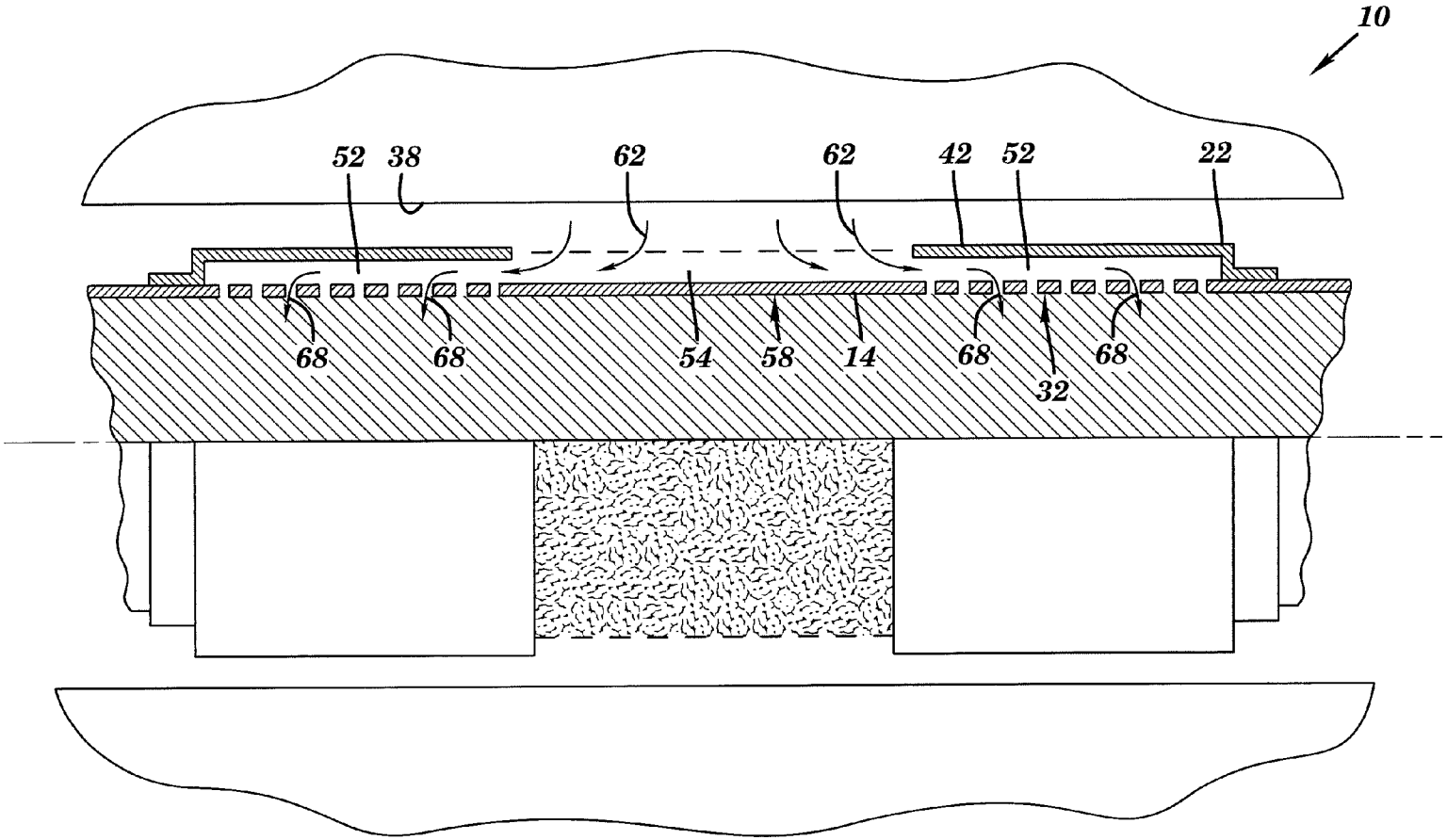
FIG. 2 depicts a partial cross sectional view of the plug protection system of FIG. 1 illustrated in a open and flowing condition.

Referring to FIG. 2, a flow path for wellbore fluid from the wellbore 38 to an inside of the perforated tubular 14 is illustrated in a non-plugged configuration of the plug protection system 10. The fluid flows through the screen 18 and then axially, along arrows 62, in an annular space 54 defined by the screen 18 and a non-perforated portion 58 of the perforated tubular member 14. The fluid then flows longitudinally from the annular space 54 to the annular space 52. From the annular space 52 the fluid is able to flow radially inwardly, along arrows 68, through the ports 30 in the perforated portions 32 to the inside of the perforated tubular member 14. Although the fluid flow path has been described herein as flowing from outside of the plug protection system 10 to the inside of the perforated tubular member 14, it should be understood that, in other applications, the fluid could flow in directions that are the reverse of those described herein.

Figure 3:
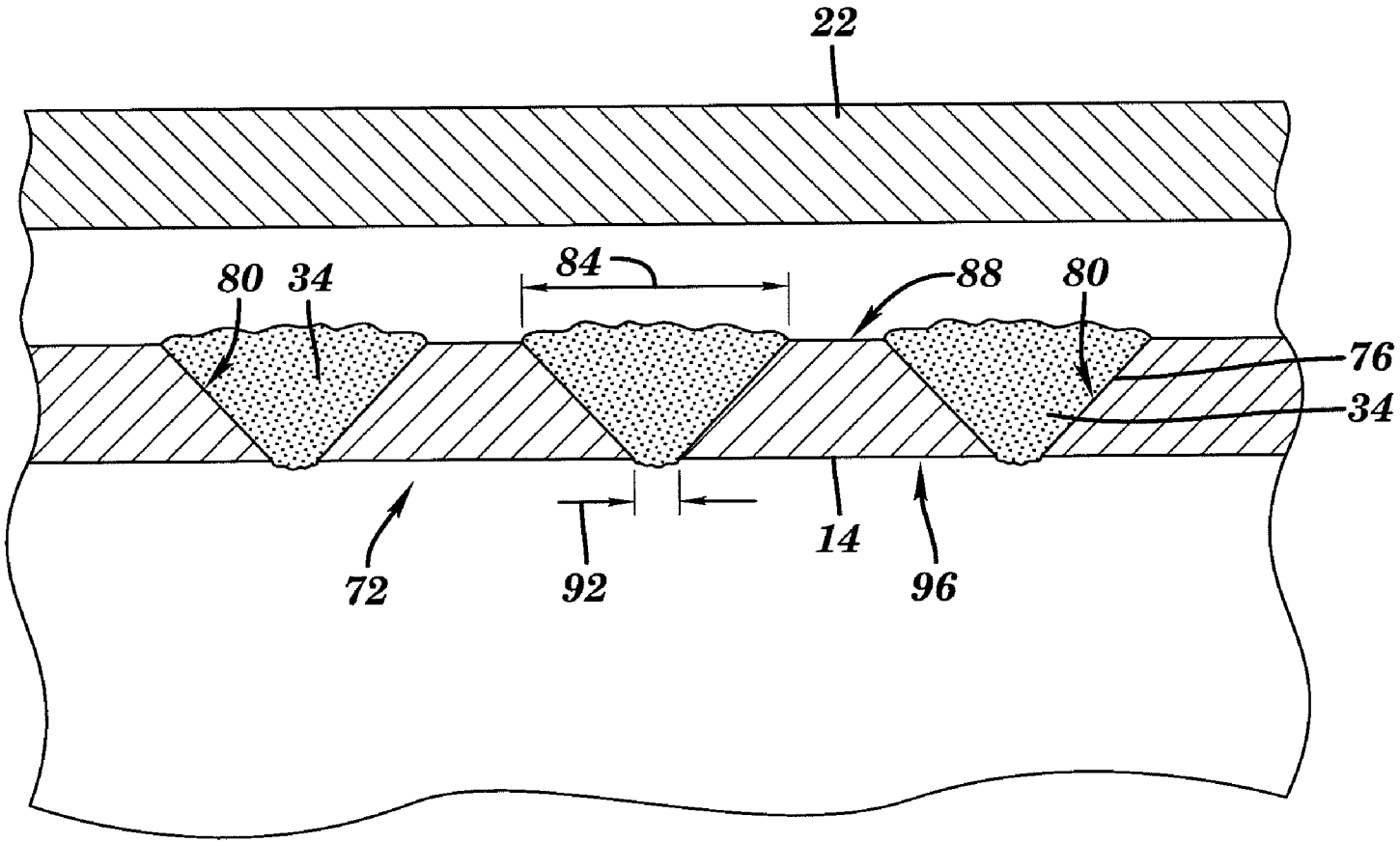
FIG. 3 depicts a magnified view of a portion of a plug protection system disclosed herein with an alternate embodiment of the perforated tubular as depicted in FIG. 1.

Referring to FIG. 3, an alternate embodiment of a perforated portion 72 of the perforated tubular member 14 is illustrated. The perforated portion 72 includes ports 76 that are designed to increase a pressure differential sufficient to force the degradable material 34 to extrude through the ports 76. The ports 76 have tapered walls 80 that create a larger cross sectional area 84 at the outer surface 88 of the perforated tubular member 14 than the smaller cross sectional area 92 at an inner surface 96 of the perforated tubular member 14. This construction creates a wedging action as the pressure differential compresses the degradable material 34 as it forces it through the ports 76. The tapering of the walls 80, in alternate embodiments, could be tapered at angles different to those disclosed herein. The walls 80 could even be tapered to narrow at locations having greater radial dimensions to increase an extrusion pressure biased in an inside to outside direction, for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole plug protection system, comprising:

a tubular having perforations in a perforated portion the perforations being plugged with a degradable material;

a screen in fluidic communication with the tubular;

a ring in sealable communication with the tubular and attached to the screen the ring having an extended portion positioned radially outwardly of the perforated portion; and a space between the perforated portion and the extended portion being plugged with a degradable material.

2. The downhole plug protection system of claim 1, wherein the perforated portion after being plugged is openable in response to degradation of the degradable material.

3. The downhole plug protection system of claim 2, wherein the degradable material is degradable at elevated temperatures.

4. The downhole plug protection system of claim 2, wherein the degradable material is degradable when exposed to acid.

5. The downhole plug protection system of claim 1, wherein the screen is positioned radially outwardly of a non-perforated portion of the tubular.

6. The downhole plug protection system of claim 1, wherein the perforations are holes with a shape that is one of circular, oval and rectangular.

7. The downhole plug protection system of claim 1, wherein cross sectional areas of the perforations are greater at locations with greater radial dimensions than at locations with lesser radial dimensions.

8. The downhole plug protection system of claim 1, wherein the space is annular.

9. A method of protecting a plugged perforated tubular while running downhole, comprising:

perforating a portion of a tubular;

plugging the perforations with degradable material;

sealedly attaching a ring to a non-perforated portion of the tubular;

perimetrically surrounding the perforated portion with a longitudinally extended portion of the ring;

plugging an annular space defined between the longitudinally extended portion of the ring and the perforated portion with degradable material; and running the plugged perforated tubular downhole.

10. The method of protecting a plugged perforated tubular while running downhole of claim 9, further comprising attaching a screen to a longitudinal end of the ring.

11. The method of protecting a plugged perforated tubular while running downhole of claim 10, further comprising perimetrically surrounding a non-perforated portion of the plugged perforated tubular with the screen.

12. A method of making a protected and plugged perforated tubular, comprising:

perforating a portion of a tubular;

plugging the perforations;

sealedly attaching a ring to a non-perforated portion of the tubular;

perimetrically surrounding the perforated portion with a longitudinally extended portion of the ring; and plugging an annular space defined between the perforated portion and the longitudinally extended portion of the ring.

13. The method of making a protected and plugged perforated tubular of claim 12, wherein the perforating the portion of the tubular includes tapering walls of the perforations so that an outer radial portion of each perforation has a greater cross sectional area than an inner radial portion.

* * * * *